US006193244B1

(12) United States Patent
Vance

(10) Patent No.: US 6,193,244 B1
(45) **Date of Patent: *Feb. 27, 2001**

(54) DUAL EDGE SNOWBOARD WITH STRAIGHT EDGE PORTIONS

(76) Inventor: Mark D. Vance, 4208 - 242nd Ave. SE., Issaquah, WA (US) 98029

( * ) Notice: Subject to any disclaimer, the term of this patent is extended or adjusted under 35 U.S.C. 154(b) by 0 days.

This patent is subject to a terminal disclaimer.

(21) Appl. No.: 09/179,237

(22) Filed: Oct. 26, 1998

(51) Int. Cl.[7] ..... B62B 13/02
(52) U.S. Cl. ..... 280/14.22; 280/608
(58) Field of Search ..... 280/608, 609, 280/610, 14.2, 18

(56) References Cited

U.S. PATENT DOCUMENTS

| | | | | |
|---|---|---|---|---|
| 3,304,095 | | 2/1967 | Carlton . | |
| 3,395,411 | | 8/1968 | Pope, Jr. et al. . | |
| 3,790,184 | * | 2/1974 | Bandrowski | 280/11.13 |
| 3,871,671 | | 3/1975 | Bildner . | |
| 4,919,447 | | 4/1990 | Jackson et al. . | |
| 4,974,868 | | 12/1990 | Morris . | |
| 5,018,760 | | 5/1991 | Remondet . | |
| 5,135,249 | | 8/1992 | Morris . | |
| 5,303,949 | | 4/1994 | Harper et al. . | |
| 5,340,144 | | 8/1994 | Eleneke . | |
| 5,462,304 | | 10/1995 | Nyman . | |
| 5,553,884 | * | 9/1996 | Abondance | 280/609 |
| 5,580,078 | | 12/1996 | Vance . | |
| 5,871,224 | * | 2/1999 | Vance | 280/608 |

FOREIGN PATENT DOCUMENTS

| | | |
|---|---|---|
| 25 57 275 | 7/1977 | (DE) . |
| 0 530 395 | 3/1993 | (EP) . |
| 1 289 117 | 2/1962 | (FR) . |

* cited by examiner

*Primary Examiner*—Brian L. Johnson
*Assistant Examiner*—Gerald Klebe
(74) *Attorney, Agent, or Firm*—Christensen O'Connor Johnson Kindness PLLC

(57) ABSTRACT

A double-edged snowboard (10) is disclosed. The snowboard includes a middle portion with a core, a tail (14) at the rear end of the middle portion, a shovel (12) at the front end of the middle portion, and a base (18) along the bottom of the middle, tail, and shovel portions of the snowboard. The base includes a central running surface (24), two outer running surfaces (26 and 28), first and second outer edges (34 and 36), first and second forward, curved, inner edges (30A and 32A), and first and second rearward, linear, inner edges (30B and 32B). The central running surface is lower in elevation than the outer running surfaces. The first and second outer edges surround a portion of the perimeter of the first and second outer running surfaces, respectively. The first and second inner edges are disposed between the central running surface and the first and second outer running surfaces, respectively. The inner and outer edges are generally symmetric about the longitudinal axis of the snowboard. The forward, curved, inner edges are generally parallel to the outer edges, whereas the rearward, linear, inner edges are nonparallel to the outer edges, and are either parallel to or converging towards the longitudinal axis of the snowboard. At least a portion of the central running surface behind the longitudinal midline may also be thicker than central running surface in front of the longitudinal midline.

27 Claims, 6 Drawing Sheets

DUAL EDGE SNOWBOARD WITH STRAIGHT EDGE PORTIONS

FIELD OF THE INVENTION

This invention relates generally to boards for carrying people over snow and, more particularly, to skis and snowboards.

BACKGROUND OF THE INVENTION

Snowboards are somewhat similar to surfboards in appearance and riding style. They are used to ride on snow rather than surf. A snowboard has a tip or "shovel," a central contact zone, and a tail. The outer sides of boards capable of easily carving turns through the snow have sidecuts, giving the boards a slight hourglass configuration. The base of a snowboard is typically similar to that of snow skis, with steel edges circumscribing the outer shape of the base. A rider stands substantially sideways on the board with his feet skewed toward the shovel of the board. The rider applies pressure to the side of the board corresponding to the desired direction of turn. This causes the board to tilt into the snow on edge and the shovel and tail of the board to flex upwardly relative to the midrunning surface. The radius of curvature of the tilted edge (the "turning edge") causes the board to carve a turn.

Because of the wide running surface of snowboards, riders may have difficulty properly tilting a board on edge to carve a turn. To avoid toe or heel drag when turning on edge, the midsection width of the board is approximately equal to the length of the boots of a rider. The shovel and tail are somewhat wider. One approach to overcoming the difficulty in tilting the board to edge is using a narrower board and skewing the feet further to avoid toe or heel drag. However, this approach is limited by the rider's desire to have a substantially sideways stance. The average preferred foot angle from directly sideways is about 27 degrees.

One attempt to provide a narrower base to help a rider to more easily edge, while still avoiding toe or heel drag, is disclosed in U.S. Pat. No. 5,018,760 to Remondet. The Remondet snowboard has an upper portion substantially as wide as the rider's boots are long and a significantly narrower (110 mm narrower) lower portion projecting well below (7 to 8 mm below) the bottom surface of the upper portion. With this narrower running surface the rider can tilt the board to initiate a turn on the narrower base with less force. If the rider continues to tilt the board he can ride on both the inner and outer edges or on the outer edge only. The Remondet board, while being easier to tilt, suffers from snow accumulation between the upper and lower portions. This tends to make the board skid as edge control is lost, especially when tilting the board from an inner to an outer edge. The Remondet configuration also increases friction between the board and the snow surface due to the height of the sidewalls of the narrower base. Constructing a board in the configuration taught by Remondet results in a thick board that is too rigid to properly flex for carving. Also, the narrowness of the lower portion of the board and the resulting high angle between the upper and lower portions results in overtracking and makes the board unstable when landing after a jump.

Remondet also teaches that the outer configuration of the board is to be asymmetric for proper force application to the sidecuts, due to a skewed foot stance. However, the skewed upward curvature of the shovel creates a problem. When varying snow conditions, bumps, or depths are encountered, the skewed shovel tends to kick the front of the board in a toe-side direction, which is disconcerting to the rider because it upsets the rider's balance.

U.S. Pat. No. 5,580,078 issued to Vance, discloses a snowboard that overcomes many of the shortcomings and undesirable characteristics of the Remondet snowboard, as well as other prior art snowboards. The Vance snowboard represents a substantial advance in the area of snowboard technology. The double edge snowboard disclosed in the Vance patent ('078) contains a central running surface and left and right outer running surfaces, the central running surface being lower than the outer running surfaces of the board. Disposed between the central running surface and the outer running surfaces are left and right curved inner edges. Additionally, left and right curved outer edges surround a portion of the perimeter of the outer running surfaces. Both the inner and outer curved edges of the snowboard disclosed in the '078 patent are of various concave curvatures that form hourglass-shaped configurations. The outer curved edges of the '078 snowboard are generally symmetric about the longitudinal axis of the snowboard, whereas the inner curved edges are positioned in a number of different orientations, depending on the desired performance characteristics of the snowboard.

The inner curved edges of the snowboard disclosed in the '078 patent are concave parabolic arcs. Alterations of the snowboard's performance characteristic are achieved by (1) positioning the curved inner edges parallel with the curved outer edges, (2) positioning the front portions of the curved inner edges closer to the curved outer edges than the rear portions of the curved inner edges, (3) positioning the rear portions of the curved inner edges closer to the curved outer edges than the front portions of the curved inner edges, or (4) positioning the curved inner edges asymmetrically with respect to the curved outer edges and the longitudinal axis of the snowboard. These various curved inner edge configurations produce improved snowboard characteristics such as increased stability, better tracking, quicker turn initiation, and quicker turn-to-turn transitioning.

Even though the Vance snowboard disclosed in the '078 patent represents a significant advancement in snowboard technology, the '078 snowboard is still subject to further improvement. Specifically, the '078 patent, while providing many advantages for "all purpose" or "all terrain" type snowboards, does not address the particular needs and requirements of high-speed racing snowboards. Racing snowboards require specific configurations to be utilized that maximize capabilities such as high-speed directional stability, high-speed straight-line stability, and highspeed tracking, as well as having a high-speed low-drag base surface configuration. The hourglass-shaped, longitudinally curved inner edges disclosed in the Vance '078 patent, do not lend themselves to optimal racing configurations.

Because the growing popularity of snowboarding has led to the emergence of competitive snowboard racing, an increased need for snowboards that are specifically designed to meet the distinct requirements associated with high-speed racing has been created. That is, there is a continually growing need for racing specific snowboards that maximize racing advantageous characteristics. This invention is directed to providing such a snowboard.

SUMMARY OF THE INVENTION

In accordance with this invention, a new and improved base for snowboards, particularly racing snowboards, is provided. While primarily intended for use with snowboards having symmetrically shaped sides, the invention can be used with other boards that include runners for carrying people over the snow, such as monoskis, regular downhill skis, and skiboards.

A base formed in accordance with this invention includes a central portion and a first outer portion. The central portion includes a central running surface and a first inner edge. The first inner edge is located along at least a portion of the perimeter of the central running surface. The first inner edge includes a forward, curved, inner edge portion and a rearward, linear, inner edge portion disposed behind the forward, curved, inner edge portion. Preferably, the forward, curved, inner edge portion and the rearward, linear, inner edge portion meet at the longitudinal midline of the base. The first outer portion is disposed adjacent the central portion and includes a first outer running surface and a first outer edge. The first outer edge is located along at least a portion of the perimeter of the first outer running surface. The first inner edge of the central portion is lower than the first outer edge. The slope of a line running between the first outer edge and the first inner edge lies in the range between 0.1 degrees and 3.0 degrees.

In accordance with other aspects of this invention, the base further includes a second inner edge and a second outer portion. The second inner edge is located along at least a portion of the perimeter of the central running surface on the opposite side of the central running surface from the first inner edge. The second inner edge also includes a forward, curved inner edge portion and a rearward, linear inner edge disposed behind the forward, curved, inner edge portion. Preferably, the forward, curved, inner edge portion and the rearward, linear, inner edge portion meet at the longitudinal midline of the base. The second outer portion is disposed adjacent the second inner edge and includes a second outer running surface and a second outer edge. The second outer edge is located along at least a portion of the perimeter of the second outer running surface. The second inner edge of the central portion is lower than the second outer edge. The slope of a line running between the second inner edge and the second outer edge lies in the range between 0.1 degrees and 3.0 degrees.

The first and second outer edges are curved inwardly toward the longitudinal axis of the board from one end of the base to the other end to form an hourglass shape. The first and second forward, curved, inner edge portions are curved inwardly toward the longitudinal axis of the board from the front end of the base to form the top half of an hourglass shape. Hence, the central running surface is also curved longitudinally from the front end of the base. The first and second rearward, linear, inner edge portions are linear from the top half hourglass shape to the rear end of the base, and are either parallel to the longitudinal axis of the board or converging towards the longitudinal axis of the board. Further, the central running surface is substantially straight across in a lateral direction along substantially the entire length of the central running surface.

The first and second forward, curved, inner edge portions are curved inwardly and each have a tangent point (at which point a line tangent to the curvature of the edge lies parallel to the longitudinal axis of the base) at the intersection point with first and second rearward, linear, inner edge portions, respectively. The running surfaces and the edges are symmetric about the longitudinal axis of the base. The first inner edge and first outer edge are the mirror image of the second inner edge and second outer edge.

In accordance with yet other aspects of this invention, the base further comprises a snow contact zone, a shovel portion in front of the contact zone and a tail portion behind the contact zone. Each of the running surfaces extends along the snow contact zone, the shovel portion, and the tail portion. The first and second forward, curved, inner edge portions lie generally parallel to the first and second hourglass-shaped outer edges, respectively, along the contact zone. The forward, curved, inner edge portions continue to the edge of the shovel portion and have an outward curvature toward the front end of the base. The outer edges (which have an outward curvature towards both the front and rear ends of the base) are disposed along at least a portion of the outer perimeter of the shovel portion of the base.

In one embodiment of the invention, the first and second rearward, linear, inner edges lie generally parallel to the longitudinal axis, along the contact zone, toward the rear end of the base. The rearward, linear, inner edges end at approximately the transition from the contact zone into the tail portion and have no curvature toward the rear end of the base. The inner edges do not end abruptly, but rather gradually blend into the base. In another embodiment of the invention, the first and second rearward, linear, inner edges converge towards the longitudinal axis, along the contact zone, toward the rear end of the base. Finally, in yet another embodiment of the invention, at least a portion of the central running surface gradually increases in elevation with respect to the first and second outer running surfaces. This modification of the central running surface elevation changes the relative angle of the slope of a line running between an inner and outer edge, thereby allowing a variety of different performance characteristics to be achieved.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
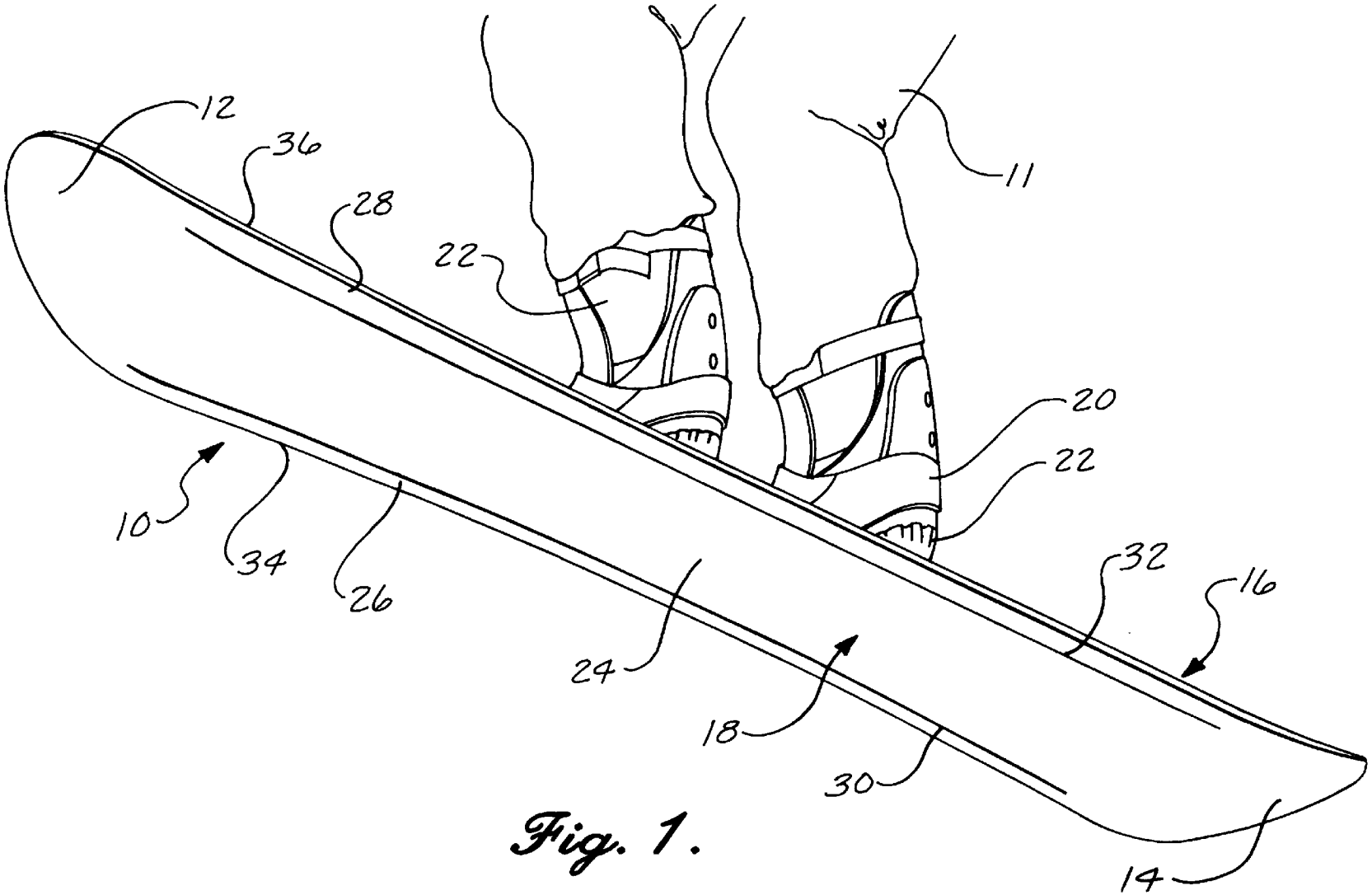
FIG. 1 is a perspective view of a snowboard formed in accordance with the present invention showing a rider secured to the top of the board.
Figure 2:
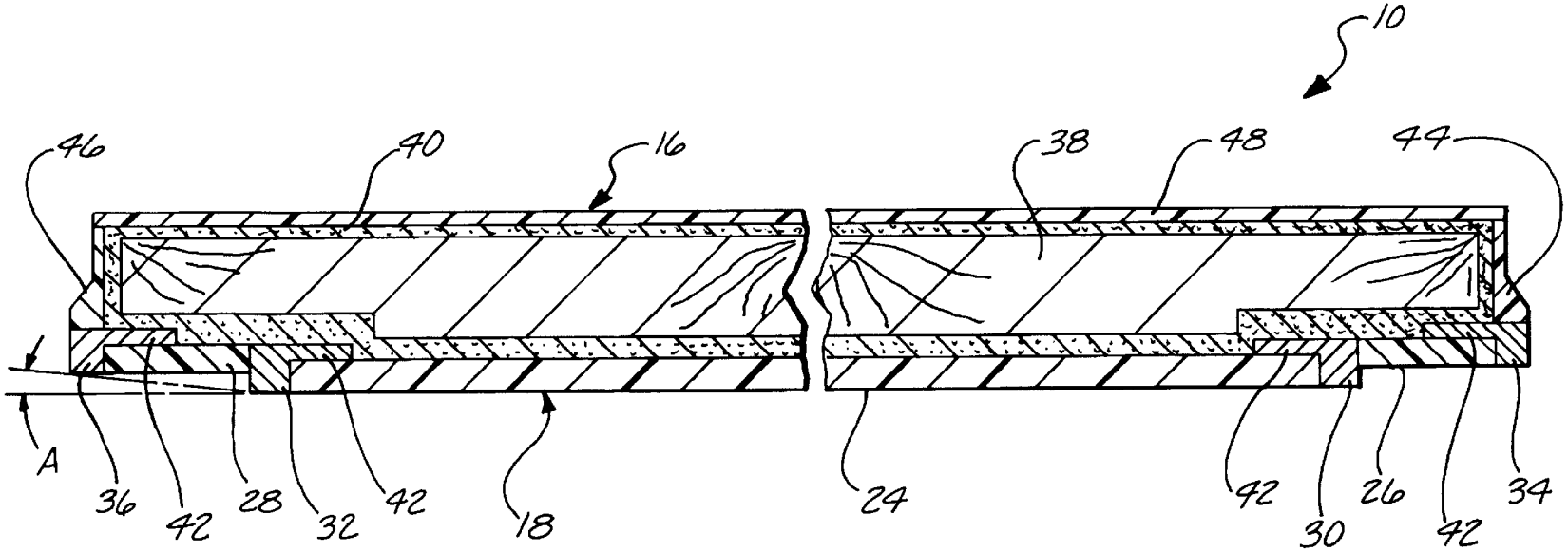
FIG. 2 is an enlarged cross-sectional view of the snowboard illustrated in FIG. 1.

FIGS. 1 and 2 illustrate a preferred embodiment of a snowboard 10 formed in accordance with the present invention supporting a rider 11. The snowboard 10 includes a shovel 12 that curves upwardly at the front of the snowboard 10 and a tail 14 that curves upwardly at the rear of the snowboard 10. The rider 11 is secured to the top 16 of the snowboard 10 by bindings 20 that hold the rider's boots 22. This is a typical rider position on a snowboard.

A base 18, disposed along the bottom of snowboard 10, includes a central running surface 24, a right running surface 26, and a left running surface 28. Used herein, the directions of left, right, front, and rear are in the context of the position of the rider 11, the part of the board to the rider's right being the "right side" and so forth. The rider 11 is shown and described as having a position generally facing the front and right side of the snowboard 10. However, a "goofy" foot arrangement wherein the rider faces the left side of the snowboard 10 is also contemplated by the invention.

The central running surface 24 is generally rectangular in shape and runs the length and most of the width of the snowboard 10. The central running surface 24 has slight sidecuts on both sides in front of the longitudinal midpoint of the snowboard 10. The central running surface 24 is preferably straight across laterally, while being curved vertically along the forward longitudinal portion of the board to provide some degree of camber to the board.

The right and left running surfaces 26 and 28 are disposed adjacent the sides of the central running surface 24. The base 18 is stepped by forming the central running surface 24 slightly lower than the right and left running surfaces 26 and 28. Preferably, the step between the central running surface 24 and the right and left running surfaces 26 and 28 is 0.72 mm. Alternatively, the step may be between 0.5 mm to 1.3 mm. The right and left running surfaces 26 and 28 also are preferably flat or straight across laterally, while being vertically curved along the longitudinal portion of the board to provide camber to the board in a manner generally corresponding to an hourglass-shaped curvature.

A right inner edge 30 is located between the central running surface 24 and the right running surface 26. The right inner edge 30 thus forms the edge of the step between the central running surface 24 and the right running surface 26. Likewise, a left inner edge 32 is positioned between the central running surface 24 and the left running surface 28, and forms the step between those two surfaces. Preferably, the front and rear ends of the right and left inner edges 30 and 32 do not end abruptly, but rather blend into outer running surfaces 26 and 28. Thus, in this manner the central running surface 24 blends into the outer running surfaces 26 and 28 as well. A right outer edge 34 is disposed along the right side of the base 18 and a left outer edge 36 is disposed along the left side of the base 18. The right and left outer edges 34 and 36 are curved inwardly toward the longitudinal axis of the board from one end of the base to the other end in order to form an hourglass shape that curves outwardly towards the front and rear ends of snowboard. Because the base 18 is slightly stepped, the snowboard 10 behaves like a convex-based snowboard in that it is easier to tilt when initiating or coming out of a turn to set an outside edge or move from one outside edge to the other outside edge.

In use, the right and left outer edges 34 and 36 are the principal carving edges of the snowboard 10. The right and left inner edges 30 and 32 form the steps in base 18 to give the rider the feeling of a convex-bottom board. The right and left inner edges 30 and 32 also perform the function of controlling sloppiness or skidding before and after the right or left outer edges 34 or 36 are set when initiating a turn, or coming out of a turn. This can be contrasted to a typical convex-based snowboard that also has ease of turn initiation, edge release, and edge-to-edge transition, but a running surface that tends to skid sideways due to the convex nature of the base not allowing an edge to set as quickly or grab the snow as readily.

Like a convex-based snowboard, a snowboard formed in accordance with this invention can also be rockered slightly for ease of turn initiation, edge release, and edge-to-edge transition. This function is carried out by the right and left inner edges 30 and 32 of the snowboard 10. These inner edges give the rider the feel of a convex-based board without having the side skidding that tends to slow the speed of the board and which diminishes the control of the rider over the board. Skidding is prevented by the right and left inner edges. More specifically, the right and left inner edges, which are preferably duller than right and left outer edges 34 and 36, keep snowboard 10 on track when making a transition to an edge or when coming out of an edge. Also, since the central running surface 24 is substantially straight across in a lateral direction along the length of the board 10, straight-line stability is maximized. Thus, the inner edges 30 and 32 provide the benefits of a convex-based snowboard without the drawbacks.

Referring again to FIG. 2, a possible exemplary construction model of snowboard 10 will now be described. A core 38 is disposed within snowboard 10 and is generally symmetric about the longitudinal axis of snowboard 10. The core 38 is preferably constructed of wood and has steps on either side corresponding to the stepped base 18. However, a wide variety of construction materials could be used to compose the core, such as polyurethane foams. Preferably, the steps of the core 38 are inside of the right and left inner edges 30 and 32. The core 38 is surrounded by a torsion box 40 preferably constructed of a composite thermoset material such as fiberglass.

These structural configurations and materials described herein are exemplary in nature. Other structural configurations or components may also alternatively be used. For example, it is contemplated that injection molding techniques could be used as an alternate board construction methodology. It is also contemplated that materials could possibly be utilized which would allow the entire base or even entire snowboard to be cut from a single piece of material, and thus not require multiple layers of materials. Further, in another alternate embodiment of this invention, the edges need not be formed at 90 degree angles, but rather could be beveled within a wide range of angles.

The running surfaces 24, 26, and 28 are located below the torsion box 40. The running surfaces 24, 26, and 28 are preferably made of P-tex plastic. P-tex is the standard material used on bases on standard downhill skis or snowboards. The central running surface 24 is bound on its right and left sides by the right and left inner edges 30 and 32, respectively. All of the edges 30, 32, 34, and 36 are preferably standard metal edges typically used in skis or snowboards. They include edge ears 42 that project inwardly and are held in place between the P-tex and fiberglass layers of the running surfaces 24, 26, and 28, and torsion box 40, respectively. The right and left inner edges 30 and 32 are also locked in place by the right and left running surfaces 26 and 28 abutting against the right and left inner edges 30 and 32. The running surfaces 24, 26, and 28 are preferably approximately 1.2 mm thick. As a result, a preferred edge thickness of 1.92 mm results in steps of 0.72 mm being formed between the central running surface 24 and the right and left running surfaces 26 and 28. The right and left running surfaces 26 and 28 are bounded on their outer sides by the right and left outer edges 34 and 36, respectively.

When the word "edge" is used within this application, it designates any type of step, e.g. the right inner edge 30 designates the step between the central running surface 24 and the right outer running surface 26. The word "edge" is not meant to apply only to a traditional metal edge piece. As previously described, it is contemplated that a snowboard base could be made from a single piece of material. In this situation the inner and outer edges of the snowboard would cut into the single piece of material. The "steps" between the central running surface and the outer running surfaces in this embodiment would still be defined as "edges" for purposes of this application.

To protect the sides of the torsion box 40, right and left sidewalls 44 and 46, disposed above right and left outer edges 34 and 36, respectively, shield the sides of snowboard 10. A top layer 48 is disposed over the entire top surface of the snowboard 10 to protect the top of torsion box 40, and to support top graphics. The top layer 48 and sidewalls 44 and 46 are preferably constructed of acrylonitrile butadiene-styrene (ABS), but may be constructed of other materials. Alternatively, top layer 48 may be integral with the right and left sidewalls 44 and 46 and extend down the sides of snowboard 10.

Of particular note in FIG. 2 is the angle A that represents the edge slope of snowboard 10. Edge slope angle A is the angle that the slope of a line between corners of right inner edge 30 and the right outer edge 34, or between the left inner edge 32 and left outer edge 36, makes with the central running surface 24. In the preferred embodiments of the invention, edge slope angle A is between 1 degree and 1.6 degrees. However, angles ranging anywhere between 0.1 degree and 3 degrees are contemplated. In the preferred embodiments illustrated and described herein, angle A lies between 1 degree and 1.6 degrees, the optimal range. Within these ranges, the board acts as a convex-based board for ease of turn initiation, edge release, and edge-to-edge transition. The board rides on all the running surfaces 24, 26, and 28, and provides a stable base for landings from jumps. When edge slope angle A lies within this range snow does not accumulate in the area between the inner and outer edges. Both the height of the step and/or the lateral distance between the edges may be varied in order to change the edge slope angle A.

FIGS. 3 through 6 illustrate various embodiments of snowboards formed in accordance with the present invention. The differences between the embodiments illustrated in FIGS. 3–6 and described below lie in the shape of the right and left inner edges 30 and 32, and the elevation of the central running surface 24 with respect to the right and left running surfaces 26 and 28 along the length of the snowboards.

Figure 3:
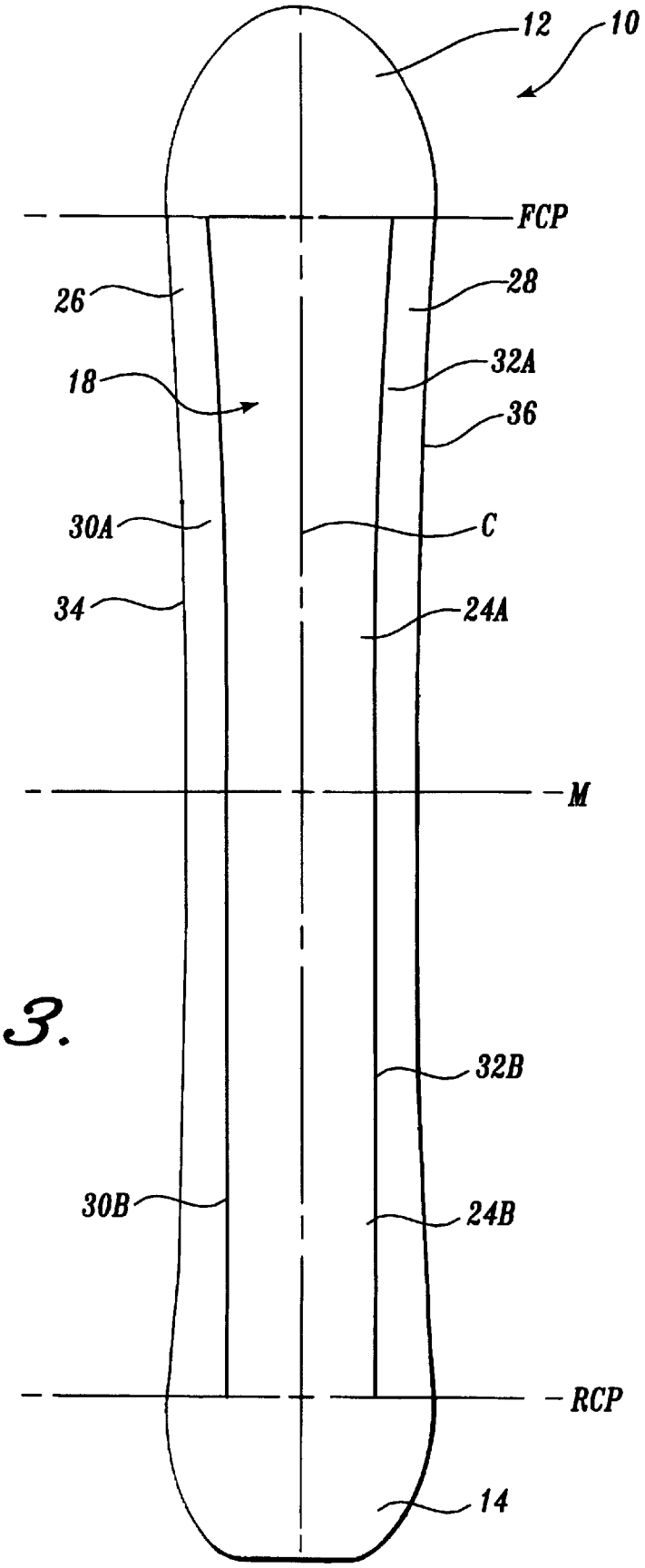
FIG. 3 is a bottom plan view of a snowboard formed in accordance with the present invention that has symmetric, forward, curved, inner edge portions and parallel rearward, linear, rear inner edge portions.
Figure 4:
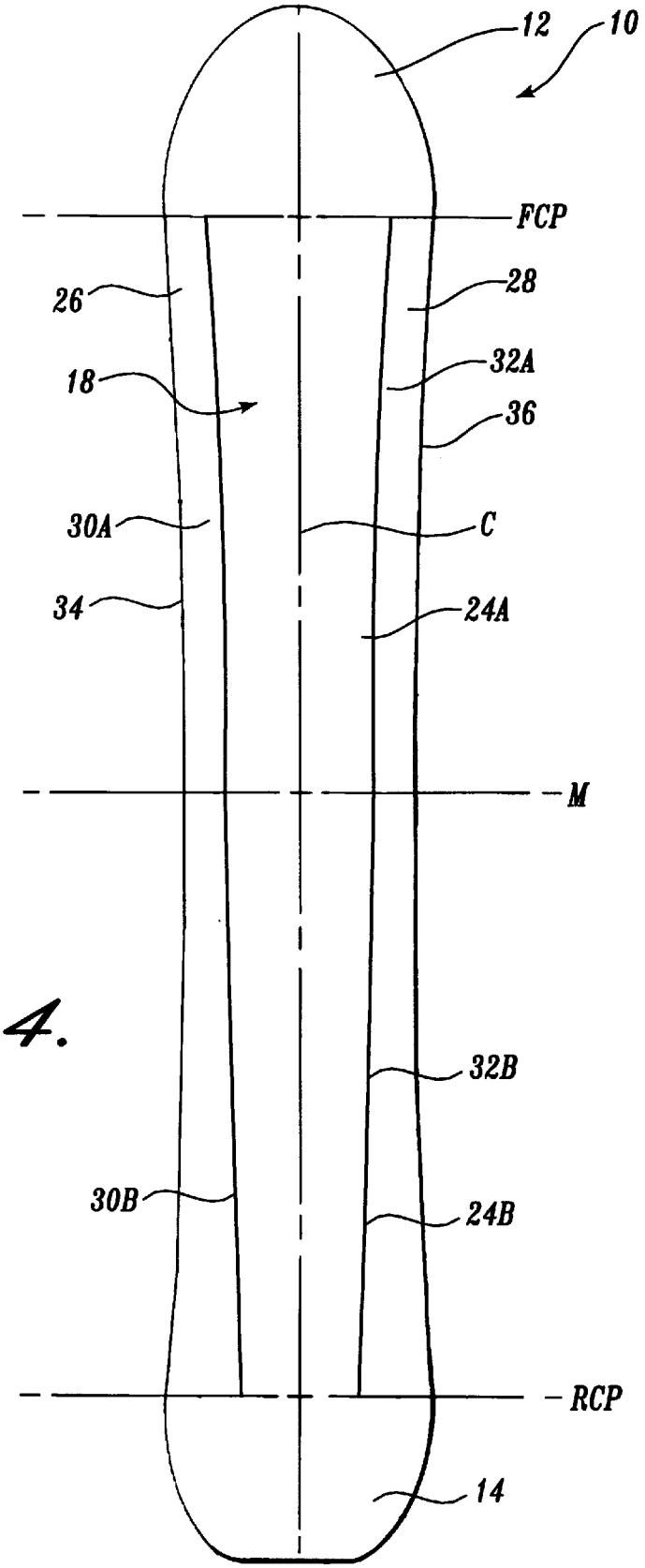
FIG. 4 is a bottom plan view of a snowboard formed in accordance with the present invention that has symmetric, forward, curved, inner edge portions and converging, rearward, linear, edge portions.

Referring to FIGS. 3 and 4, the inner edges 30 and 32 are configured in shapes that provide important advantages for snowboard racing applications. Specifically, the inner edges 30 and 32 contain first and second forward, curved inner edge portions 30A and 32A disposed in front of the longitudinal midline M of the snowboard 10, and first and second rearward, linear, inner edge portions 30B and 32B disposed behind the longitudinal midline M of the snowboard. Thus, the central running surface 24 also can be described as having a forward, curved, central running surface 24A and a rearward, linear, central running surface 24B. While, preferably, the first and second forward, curved, inner edge portions and the first and second rearward, linear, inner edge portions meet at the longitudinal midline M, they can meet ahead of or behind the midline M.

The entire length of the rearward, linear, inner edge portions 30B and 32B are closer or equal in distance to the longitudinal centerline C of the snowboard than the closest point to the longitudinal centerline C of the forward, curved, inner edge portions 30A and 32A. Since the forward, curved, inner edge portions 30A and 32A are wider than the rearward, linear, inner edge portions 30B and 32B, the rear portion of the central running surface 24B readily tracks completely within the trail made by the forward end of the central running surface 24A as it passes across the snow. This results in a dramatic reduction in the amount of drag experienced by the snowboard 10. Thus, the snowboard can achieve speeds on the order of 30 percent higher than a snowboard with hourglass-shaped, symmetrically curved front and rear inner edges.

Enhanced tracking and high-speed stability are additional benefits also derived from the above described, curved front/linear rear, inner edge configuration. This is due to the elimination of the outwardly flaring rear inner edges which have the potential to catch or hang up on various snow surface anomalies, particularly at high rates of speed.

In straight away, racing situations where the snow surface is substantially smooth, the rider 11 of a snowboard 10 constructed in accordance with the present invention, also has the ability to lean back slightly on the snowboard, and thereby maximize the amount of linear inner edge 30B and 32B and central running surface 24B in contact with the snow, and minimize the amount of forward outwardly curved, inner edge 30A and 32A and central running surface 24A in contact with the snow. In this manner, the drag experienced by the snowboard can be further decreased through the above-described additional reduction of non-linear central running surface 24A in snow contact.

The preferred embodiment of a snowboard 10 formed in accordance with this invention is shown in FIG. 3. The forward, curved, inner edges 30A and 32A of this embodiment of the invention lie parallel to the forward portion of the outer edges 34 and 36 between a front contact point (FCP) located near the wide part of the front of snowboard 10 adjacent shovel 12, and the longitudinal midline M of the snowboard. The rearward, linear, inner edges 30B and 32B lie parallel to the longitudinal axis C between the longitudinal midline M and a rear contact point (RCP) located near the wide part of the snowboard 10 near the tail 14. In other words, the curvature of the forward, curved, right inner edge 30A is the same as the curvature of the right outer edge 34 only between the FCP and the longitudinal midline M, and the curvature of the forward, curved, left inner edge 32A is the same as the curvature of the left outer edge 36 only between the FCP and the longitudinal midline M. Behind the longitudinal midline M the rearward, linear, inner edges 30B and 32B are parallel to each other and the longitudinal axis C of the snowboard 10.

Preferably, the right and left forward, curved, inner edges 30A and 32A only extend approximately to FCP, and do not continue onto the shovel 12. This arrangement provides the advantage of a more stable board when encountering differing snow conditions, bumps, or depths. As the front or rear of the snowboard 10 encounters differing snow depths, for example, the snowboard 10 is not as likely to be thrown to the right or the left since the curvature of the forward, curved, inner edges 30A and 32A continues approximately to the FCP.

Another way of describing the parallel nature of the forward, curved, inner edges 30A and 32A, with the forward portions of the outer edges 34 and 36, in the preferred embodiments of the invention, is to focus on the points where lines that are tangent to the curvature of the edges lie parallel to the longitudinal axis C of the snowboard 10. The points along each edge at which lines that lie tangent to the edge are parallel to the longitudinal axis of snowboard 10 are all disposed along the midline M, of the snowboard 10.

The linear, parallel, rearward inner edges 30B and 32B of the embodiment of the invention as illustrated in FIG. 3, provide racing specific advantages over outwardly curved rear inner edges. The snowboard 10 experiences a dramatically reduced amount of drag because the forward, curved, inner edges 30A and 32A (which flare outwardly) are wider than the rearward, linear, inner edge portions 30B and 32B (which are parallel to the longitudinal centerline C and each other), and thus, the rear portion of the central running surface 24B readily tracks completely within the trail made by the forward end of the central running surface 24A as it passes across the snow. This significantly increases the speed potential of such a snowboard 10. It has been found that a snowboard of the type illustrated in FIG. 3 can achieve speeds on the order of 30 percent higher than a snowboard with outwardly flaring rear inner edges.

A snowboard of this linear, parallel, rearward inner edge configuration also derives the additional benefits of enhanced tracking and high-speed directional stability. Furthermore, although the above described inner edge configuration is designed to provide racing specific advantages, this snowboard base configuration still allows for bidirectional use of the snowboard 10, i.e. the snowboard can be ridden "backwards" with the tail 14 in front and the shovel 12 in the rear, as well as "forwards" with the tail 14 in the rear and the shovel 12 in front, as is primarily intended. Although the specific racing advantages of the present invention will not be obtained when the snowboard is ridden "backwards," the mere ability of the snowboard to still be utilized for bidirectional use, broadens the utility of the snowboard.

The embodiment of the invention shown in FIG. 4 is similar to the embodiment of the invention shown in FIG. 3 except that the rearward, linear, inner edges 30B and 32B progressively converge towards the longitudinal axis C, moving in the direction of the rear of the snowboard 10. This configuration is designed to be highly racing specific, fully exploiting the base configuration for high speed use. However, this also results in the snowboard being useable only uni-directionally, i.e. "forward" use, with the tail 14 in the rear and the shovel 12 in front of the snowboard. A base configuration that utilizes converging rearward inner edges 30B and 32B is believed to be simply too radical of a racing cut to allow "backwards" use, which would result in linear diverging, forward inner edges.

The embodiment illustrated in FIG. 4, with rearward, linear, inner edges 30B and 32B progressively converging towards the rear of the snowboard 10, is believed to provide racing specific advantages of even higher potential snowboard speed, further increased tracking, and further increased high-speed, straight-line stability. The increased potential snowboard speed and enhanced tracking result is believed due to the same reasons described above with respect to the embodiment of the invention shown in FIG. 3. This snowboard base configuration, which utilizes linear, converging, rearward inner edges 30B and 32B, is highly racing specific, and as such does not possess increased small radius turning capabilities, but rather possesses maximized high-speed, straight-line stability. The embodiment illustrated in FIG. 4 is the same in all other aspects as the embodiment illustrated in FIG. 3, including the configuration of the forward, curved inner edges 30A and 32A.

Figure 5:
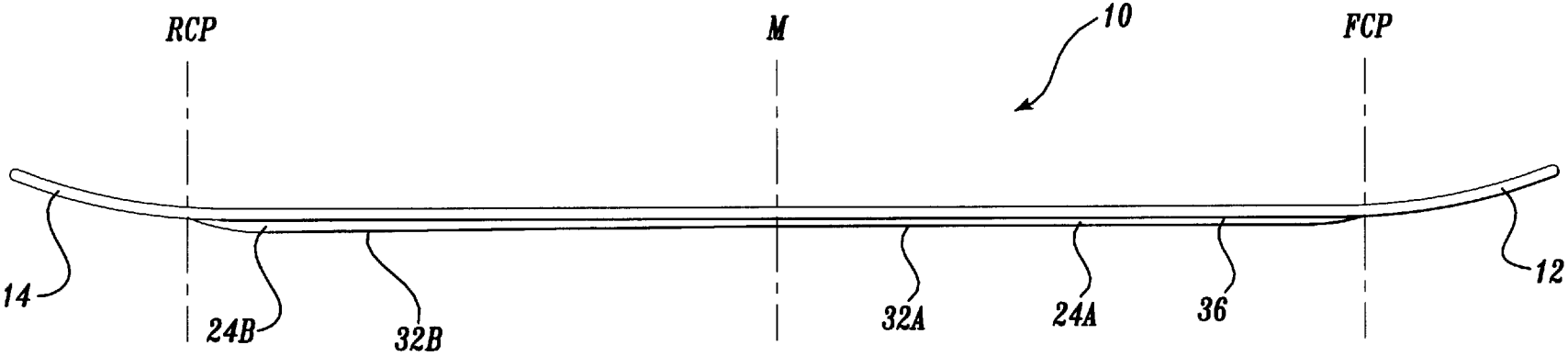
FIG. 5 is a side view of a preferred embodiment of a snowboard formed in accordance with the present invention that has a central running surface whose elevation with respect to first and second outer portions increases toward the rear of the snowboard.

FIG. 5 illustrates that the step height of either of the embodiments of a snowboard formed in accordance with the invention illustrated in FIGS. 3 and 4 may be greater between the rearward, linear, central running surface 24B and the left and right running surfaces 26 and 28, than between the forward, curved, central running surface 24A and the left and right running surfaces 26 and 29. More specifically, the rearward, linear, inner edges 30B and 32B of the rearward, linear, central running surface 24B are either parallel to the longitudinal axis C and each other, or are converging towards the longitudinal axis C of the snowboard. Since, as previously stated, the outer edges 34 and 36 of the snowboard flare outwardly towards the rear end of the snowboard, the rearward, linear, inner edges 30B and 32B move farther away from the outer edges 34 and 36, respectively, towards the rear of the snowboard. As shown above in FIG. 2, the distance between the inner and outer edges represents the denominator of an equation for determining an edge slope angle A. If the height of the step between the rear central running surface 24B and the outer running surfaces 26 and 28 remains constant while the distance between the inner and outer edges increases, then the edge slope angle A will decrease progressively towards the rear of the snowboard.

Because slower turning capability may result when the edge slope angle A becomes smaller toward the rear of snowboard 10, in some snowboards it may be desirable to maintain the edge slope angle A constant for a substantially greater distance along the rearward length of the snowboard, or reduce the rate of angle decrease. FIG. 5 illustrates that this can be accomplished by increasing the height of the step between the rear central running surface 24B and the outer running surfaces 26 and 28, toward the rear of the snowboard. In one embodiment of the invention, the step height is increased so as to maintain the same edge slope angle A from behind the longitudinal midline M to a point near the rear contact point (RCP). Mathematically this translated into the thickness of the rear central running surface 24B rising from approximately 0.72 mm (as in the front of the snowboard) to a high point of approximately 1.4 mm for a snowboard with rearward, linear inner edges 30B and 32B that are parallel to each other and the longitudinal axis C of the snowboard. This high-point is located approximately 4 cm in front of the RCP at which point the step thickness tapers until flush at the RCP.

Increasing the step thickness so as to achieve many different variations of the magnitude of edge slope angle A is contemplated by the invention. Various values of edge slope angle A, can be achieved by selecting step heights in the range of just above 0.72 mm up to approximately 4 mm. Configuring a snowboard of the present invention with a heightened rear central running surface increases the edge slope angle A which in turn facilitates quicker turning ability. This is added to the enhanced racing benefits detailed above for the embodiments of FIGS. 3 and 4, particularly for slalom racing snowboards.

When the edge slope angle A is larger at the rear of the snowboard, the outer edges 34 and 36 at the front are quicker to grab into the snow and initiate a turn, resulting in a snowboard that is quicker turning. As such, a snowboard 10 proceeds through a turn and is shifted in the other direction to initiate another turn, and the larger edge slope angle A at the rear of the snowboard 10 results in quicker release of the outer edges 34 and 36 at the rear of the snowboard 10. Thus, turn-to-turn transitions of this snowboard are quicker.

Figure 6:
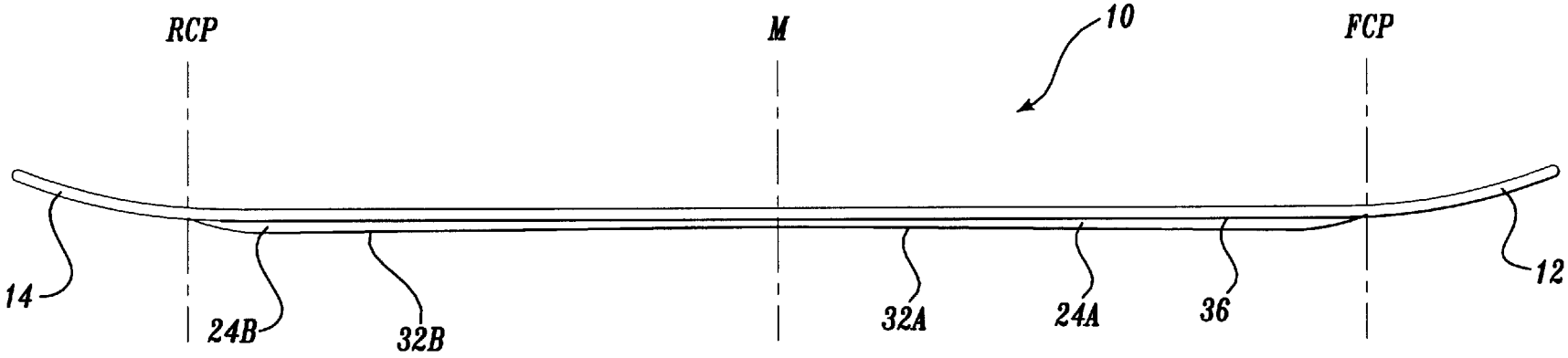
FIG. 6 is a side view of a preferred embodiment of a snowboard formed in accordance with the present invention that has a central running surface whose elevation with respect to first and second outer portions increases toward the front and the rear of the snowboard.

FIG. 6 illustrates another alternate embodiment of the present invention which is the same as the snowboard 10 of FIG. 5 except for having an increased step thickness in the front region of the snowboard, in addition to (or instead of)

the increased step thickness in the rear of the snowboard, which further modifies the turning capabilities of the board. The front step thickness high-point is located approximately 4 cm to the rear of the FCP at which point the step thickness tapers until flush at the FCP. Therefore, by increasing the step thickness in particular areas of the snowboard, and thus modifying the slope angle A, turn initiation, step release, and the degree of tracking can be adjusted to moderate the ride and "feel" provided by the snowboard. In this manner, the snowboard can be "tuned" for a particular use, style, or rider preference.

The present invention has been described in relation to a preferred embodiment and several alternate embodiments. One of ordinary skill after reading the foregoing specification, may be able to effect various other changes, alterations, and substitutions or equivalents without departing from the concepts disclosed. It is therefore intended that the scope of the letters patent granted hereon be limited only by the definitions contained in the appended claims and equivalents thereof.

The embodiments of the invention in which an exclusive property or privilege is claimed are defined as follows:

1. A base for a runner for gliding over snow, the runner having a core, the base comprising:

(a) a central portion coupled to the core, said central portion including a central running surface, generally defining a central surface plane, and a first inner edge located along at least a portion of the perimeter of said central running surface, said first inner edge comprising a forward, curved, first inner edge portion and a rearward, linear, first inner edge portion; and (b) a first outer portion disposed adjacent said central portion, said first outer portion including a first outer running surface and a first outer edge located along at least a portion of the perimeter of said first outer running surface, wherein said first inner edge of said central portion is lower than said first outer edge, the angle generally midway along the length of said central running surface between the central surface plane and a line running between the first outer edge and the first inner edge lying in the range of between 0.1 and 3.0 degrees.

2. The base of claim 1, further comprising:

(a) a second inner edge located along at least a portion of the perimeter of said central running surface on the opposite side of the central running surface from said first inner edge, said second inner edge comprising a forward, curved, second inner edge portion and a rearward, linear, second inner edge portion; and (b) a second outer portion disposed adjacent the second inner edge, said second outer portion including a second outer running surface and a second outer edge located along at least a portion of the perimeter of said second outer running surface, wherein said second inner edge of said central portion is lower than said second outer edge, the angle generally midway along the length of said central running surface between the central surface plane and a line running between said second inner edge and said second outer edge lying in the range of between 0.1 and 3.0 degrees.

3. The base of claim 2, wherein said core has a longitudinal midline and wherein said central running surface is:

(a) curved longitudinally in front of the longitudinal midline;

(b) linear longitudinally behind the longitudinal midline; and (c) substantially straight across in a lateral direction along substantially the entire length of said central running surface.

4. The base of claim 2, wherein said first and second outer running surfaces abut said first and second inner edges, respectively, said first and second inner edges being locked into position between said central running surface and said outer running surfaces.

5. The base of claim 2, wherein at least a portion of said first inner edge lies generally parallel to said first outer edge, and at least a portion of said second inner edge lies generally parallel to said second outer edge.

6. The base of claim 2, further comprising a longitudinal centerline, a snow contact zone, a shovel portion in front of said snow contact zone, and a tail portion behind said contact zone, wherein each of said running surfaces extends along said snow contact zone;

wherein at least a portion of said first and second forward, curved inner edges lie generally parallel to said first and second outer edges, respectively, along said snow contact zone, and said forward, curved, inner edges having an outward curvature towards the front end of the base; and wherein said first and second rearward, linear inner edges lie generally parallel to the longitudinal axis of the base, and are progressively further away from said first and second outer edges, respectively, as the rearward, linear inner edges continue towards the rear end of the base, said outer edges being disposed along at least a segment of the outer perimeter of said rear end of the base.

7. The base of claim 6, wherein said running surfaces and said edges are symmetric about the longitudinal axis of the base, the first inner edge and first outer edge being the mirror image of said second inner edge and second outer edge.

8. The base of claim 6, wherein each of said forward, curved inner edges has a tangent point at which a line tangent to the curvature of the forward, curved inner edge at that point is parallel to the longitudinal axis of the base, and wherein the tangent points for said forward, curved inner edges are approximately at the points of intersection with the corresponding rearward, linear inner edges, respectively.

9. The base of claim 2, further comprising a snow contact zone, a shovel portion in front of said snow contact zone, and a tail portion behind said contact zone, wherein each of said running surfaces extends along said snow contact zone;

wherein at least a portion of said first and second forward, curved inner edges lie generally parallel to said first and second outer edges, respectively, along said snow contact zone, and said forward, curved, inner edges having an outward curvature towards the front end of the base; and wherein said first and second rearward, linear inner edges converge in the rearward direction towards the longitudinal axis of the base, and are progressively further away from said first and second outer edges, respectively, as the rearward, linear inner edges continue towards the rear end of the base, said outer edges being disposed along at least a segment of the outer perimeter of the rear end of the base.

10. The base of claim 9, wherein said running surfaces and said edges are symmetric about the longitudinal axis of the base, the first inner edge and first outer edge being the mirror image of the second inner edge and second outer edge.

11. The base of claim 9, wherein each of said forward, curved inner edges has a tangent point at which a line tangent to the curvature of the forward, curved inner edge at that point is parallel to the longitudinal axis of the base, and wherein the tangent points for said forward, curved inner edges are approximately at the points of intersection with the corresponding rearward, linear inner edges, respectively.

12. The base of claim 2, wherein the elevation of at least a region of the rear central portion of said base with respect to first and second outer portions is lower than the forward central portion of said base with respect to said first and second outer portions.

13. The base of claim 12, wherein at least a section of the rear central portion gradually becomes lower in elevation than the forward central portion in approximate relationship to the distance between the inner edges and the outer edges, which increases towards the rear of the base.

14. The base of claim 12, wherein the slope of a line running between the first inner edge and the first outer edge with respect to the plane of the central running surface remains approximately equal along the length of the first inner edge as the rearward, linear portion of the first inner edge moves progressively further away from the first outer edge, and wherein the slope of a line running between the second inner edge and the second outer edge with respect to the plane of the central running surface remains approximately equal along the length of the second inner edge as the rearward, linear portion of the second inner edge moves progressively further away from the second outer edge.

15. The base of claim 2, wherein the elevation of at least a region of the forward central portion of said base with respect to first and second outer portions is lower than the rear central portion of said base with respect to said first and second outer portions.

16. The base of claim 2, wherein the base has front and rear ends;

wherein the slope of a line running between said first inner edge and said first outer edge with respect to the plane of said central running surface is greater at the front end of the base than at the rear end; and wherein the slope of a line running between said second inner edge and said second outer edge with respect to the plane of said central running surface is greater at the front end of the base than it is at the rear end.

17. A snowboard comprising:

(a) a middle portion including a core;

(b) a tail at the rear of said middle portion;

(c) a shovel at the front end of said middle portion; and (d) a base along the bottom of the middle, tail, and shovel of the snowboard, said base including:

(i) a central running surface generally defining a central surface plane;

(ii) two outer running surfaces, a portion of said central running surface along said middle portion being lower than said outer running surfaces along said middle portion;

(iii) first and second outer edges surrounding a portion of the perimeter of said first and second outer running surfaces, respectively; and (iv) first and second inner edges disposed between said central running surface and said first and second outer running surfaces, respectively;

said first and second inner edge each comprising a forward, curved inner edge and a rearward, linear, inner edge;

the angle generally midway along the length of said central running surface between the central surface plane and a line between the first inner edge and the first outer edge being less than about 3.0 degrees and the angle generally midway along the length of said central running surface between the central surface plane and a line between the second inner edge and the second outer edge being less than about 3.0 degrees.

18. The snowboard of claim 17, wherein the snowboard has a longitudinal midline and wherein said central running surface is:

(a) curved longitudinally in front of the longitudinal midline;

(b) linear longitudinally behind the longitudinal midline; and (c) laterally substantially flat.

19. The snowboard of claim 17, wherein said outer running surfaces abut said first and second inner edges, respectively, said first and second inner edges being locked into position between said central running surface and said outer running surfaces.

20. The snowboard of claim 17, wherein said first and second rearward, linear inner edges lie generally parallel to the longitudinal axis of the base, and are progressively further away from said first and second outer edges, respectively, as the rearward, linear inner edges extend into the tail of the snowboard, said outer edges being disposed along at least a segment of the outer perimeter of the tail of the snowboard.

21. The snowboard of claim 17, wherein said first and second rearward, linear inner edges converge in the rearward direction towards the longitudinal axis of the base, and are progressively further away from said first and second outer edges, respectively, as the rearward, linear inner edges extend into the tail of the snowboard, said outer edges being disposed along at least a segment of the outer perimeter of the tail of the snowboard.

22. The snowboard of claim 17, wherein at least a portion of the central running surface to the rear of the snowboard gradually becomes lower in elevation than the central running surface to the front of the snowboard in approximate relationship to the distance between the inner edges and the outer edges, which increases towards the rear of the base.

23. The snowboard of claim 17, wherein at least a portion of the central running surface to the front of the snowboard gradually becomes lower in elevation than the central running surface to the rear of the snowboard.

24. The snowboard of claim 17, wherein said first and second forward, curved inner edges lie generally parallel to said first and second outer edges.

25. The snowboard of claim 17, wherein:

the slope of a line between said first inner edge and said first outer edge is greater near the shovel of said snowboard than it is near said tail; and the slope of a line between said second inner edge and said second outer edge is greater near the shovel of the snowboard than it is near the tail.

26. A base for a runner for gliding over snow, the runner having a core, the base comprising:

(a) a central portion coupled to the core, said central portion including a central running surface and first and second inner edges located along at least a portion of the perimeter of said central running surface, said second inner edge being located along at least a portion of the perimeter of said central running surface on the opposite side of said central running surface from said first inner edge; and said first and second inner edges comprising forward, curved, inner edge portions and rearward, linear, inner edge portions;

(b) a first outer portion disposed adjacent said first inner edge, said first outer portion including a first outer running surface and a first outer edge located along at least a portion of the perimeter of said first outer running surface, wherein said first inner edge of said central portion is lower in elevation than said first outer edge; and (c) a second outer portion disposed adjacent said second inner edge, said second outer portion including a second outer running surface and a second outer edge located along at least a portion of the perimeter of said second outer running surface, wherein said second inner edge of said central portion is lower in elevation than said second outer edge;

wherein (i) each of said forward, curved, inner edges has a tangent point at the longitudinal midline of the base at which a line tangent to the curvature of the forward, curved inner edge is parallel to the longitudinal axis of the base, (ii) said outer edges are symmetric about the longitudinal axis of the base, (iii) at least a portion of said forward, curved, inner edges are parallel with respect to said outer edges forward of the longitudinal midline, (iv) said rearward, linear, inner edges are nonparallel with respect to said outer edges behind the longitudinal midline and are symmetrical with respect to each other, and (v) the tangent points of said forward, curved, inner edges and the tangent points of said outer edges lie along a common lateral line that lies orthogonal to the longitudinal axis of the base.

27. A base for a runner for gliding over snow, the base having a front and a longitudinal midline, the base comprising:

(a) a central portion including a central running surface, generally defining a central surface plane;

(b) a first inner edge located along at least a portion of the perimeter of said central running surface, said first inner edge comprising a forward, curved, first inner edge disposed in front of the longitudinal midline and a rearward, linear, first inner edge disposed behind the longitudinal midline;

(c) a first outer portion disposed adjacent said first inner edge, said first outer portion including a first outer running surface;

(d) a first outer edge located along at least a portion of the perimeter of said first outer running surface;

(e) a second inner edge located along at least a portion of the perimeter of said central running surface on the opposite side of said central running surface from said first inner edge, said second inner edge comprising a forward, curved, second inner edge disposed in front of the longitudinal midline and a rearward, linear, second inner edge disposed behind the longitudinal midline;

(f) a second outer portion disposed adjacent said second inner edge, said second outer portion including a second outer running surface; and (g) a second outer edge located along at least a portion of the perimeter of said second outer running surface, wherein (i) said first and second inner edges of said central portion are lower than said first and second outer edges, respectively; (ii) at least a portion of said forward, curved, inner edges are parallel with respect to said outer edges; (iii) said rearward, linear, inner edges are nonparallel with respect to said outer edges; (iv) said first inner and outer edges are longitudinally symmetric with respect to said second inner and outer edges; and (v) each of said forward, curved, inner edges has a tangent point at the longitudinal midline of the base at which a line tangent to the curvature of the forward, curved inner edge is parallel to the longitudinal axis of the base.

* * * * *